US006474517B1

(12) United States Patent
Sutton

(10) Patent No.: US 6,474,517 B1
(45) Date of Patent: Nov. 5, 2002

(54) CLAMP-TYPE GARMENT HANGER

(75) Inventor: Steven Sutton, Brooklyn, NY (US)

(73) Assignee: The Accessory Corporation, New York, NY (US)

( * ) Notice: Subject to any disclaimer, the term of this patent is extended or adjusted under 35 U.S.C. 154(b) by 132 days.

(21) Appl. No.: 09/891,789

(22) Filed: Jun. 26, 2001

(51) Int. Cl.[7] ..... A47G 25/48
(52) U.S. Cl. ..... 223/96
(58) Field of Search ..... 223/90, 91, 93, 223/96, 95, 85

(56) References Cited

U.S. PATENT DOCUMENTS 2,496,531 A * 2/1950 Gray ..... 223/96
6,019,261 A * 2/2000 Morgan et al. ..... 223/96
6,105,836 A * 8/2000 Batts et al. ..... 223/96
6,119,906 A * 9/2000 Bond et al. ..... 223/96

* cited by examiner

*Primary Examiner*—Bibhu Mohanty
(74) *Attorney, Agent, or Firm*—David P. Gordon; David S. Gordon; Tom A. Gallagher

(57) ABSTRACT

A garment hanger includes a clamp having a pair of jaw members, wherein at least one jaw member is pivotable relative to the other between open and closed positions. The jaw members are provided with an arrangement of ridges, at least some of the ridges defining a plurality of teeth. The ridges are preferably arranged in three rows in each of the jaw members, and each row preferably extends substantially across the respective jaw member. Each of the ridges preferably has a rear wall which extends substantially perpendicular to the surface on which the ridges are located, and a front wall which extends from the surface on which the ridges are located to the rear wall such that each of the ridges in cross-section has a cuspid-like appearance. The clamp has been demonstrated to have superior gripping ability on denim jeans garments.

29 Claims, 4 Drawing Sheets

CLAMP-TYPE GARMENT HANGER

BACKGROUND OF THE INVENTION

1. Field of the Invention

The present invention relates to clamp-type garment hangers. More specifically, the present invention relates to a pinch clamp for securing a garment, and particularly denim jeans, to a garment hanger.

2. State of the Art

Clamp-type garment hangers having at least one clamp are well-known for the suspension or hanging of garments such as pants, skirts, etc. The "pinch-type" clamp is a variety of clamp which has a clamp end having a pair of opposed clamp or jaw members between which a portion of the garment is secured, and a handle portion having a pair of spaced apart handles. Provision is made for biasing the jaw members towards each other to create the clamping force necessary to retain an a garment between inner surfaces of the jaw members. The jaw end of the clamp is hinged to the handle portion such that squeezing or pinching the handles toward one another, i.e., to reduce the space between the handles, causes the jaw members to open to receive or release a garment. To further retain the garment between the inner surfaces of the members, the clamp or jaw members typically also include inner surfaces gripping elements or friction increasing surfaces.

An example of a pinch-type clamp hanger is shown in U.S. Pat. No. 5,398,854 to Blanchard, which describes a hanger with a clamp having a jaw end, a handle portion at an opposite end from the jaw end, and a hinge point between the two ends. The jaw ends are provided with resilient friction pads to engage a garment provided in the clamp. A C-shaped spring clip provides the means for biasing the jaws to a closed position. Another exemplar pinch-type clamp hangers is shown in U.S. Pat. No. 4,395,799 to Batts. This clamp hanger has two sets of toothed elements on the inside of one of the jaws, which surround a single toothed element on the other of the jaws to secure a garment in the clamp of the hanger.

While the known pinch-type clamp hangers are useful in holding a variety of garments, all the known pinch-type clamp hangers fail at adequately holding denim jeans. The denim of jeans can be relatively thick and heavy, and due to the weight and characteristics of the denim material, jeans tend to be prematurely released from the currently available clamps. When garments are prematurely released from a hanger, garments may be lost or damaged, or the garments must be re-hung in a time consuming process.

SUMMARY OF THE INVENTION

It is therefore an object of the invention to provide a pinch-type garment clamp for a garment hanging device which does not release a jeans garment accidentally during shipping, transportation or handling.

It is another object of the invention to provide a pinch-type garment clamp which retains a jeans garment more securely.

It is a further object of the invention to provide a pinch-type garment clamp which readily permits release of the garment when desired.

It is also an object of the invention to provide a secure clamp for a garment hanging device which is inexpensively and easily manufactured.

In accordance with the preferred embodiment, a hanger has at least one clamp which includes a handle portion connected to a pair of jaw members, wherein at least one jaw member is pivotable relative to the other. The jaw members are capable of being in a closed position where one jaw member is urged towards the other jaw member sufficiently to secure a garment, and an open position where one jaw member is pivoted away from the other jaw member to receive or release the garment. The jaw members are provided with an arrangement of ridges, at least some of which define a plurality of teeth. The ridges are preferably arranged in three rows in each of the jaw members, and each row preferably extends substantially across the respective jaw member. In a first jaw member, a front ridge preferably defines four teeth, a second ridge preferably defines five teeth, and a third ridge preferably defines one elongate tooth. In a second jaw member, a front ridge preferably defines two teeth, a second ridge preferably defines four teeth, and a third ridge preferably defines one elongate tooth.

When the jaw members are in the closed position, the front ridge of the second jaw member is directed toward the base of the front ridge of the first jaw member, the second ridge of the second jaw member is directed toward the base of the second ridge of teeth of the first jaw member, and the third ridge of the second jaw member is directed toward the base of the third ridge of the first jaw member. Each of the ridges preferably has a rear wall which extends substantially perpendicular to the surface on which the respective ridge is located, and a front wall which extends from the surface on which the respective ridge is located to the rear wall such that each of the ridges in cross-section has a cuspid-like appearance.

The clamp of the hanger has been demonstrated to have superior gripping ability on denim jeans garments, but may be useful to securely grip other garments.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
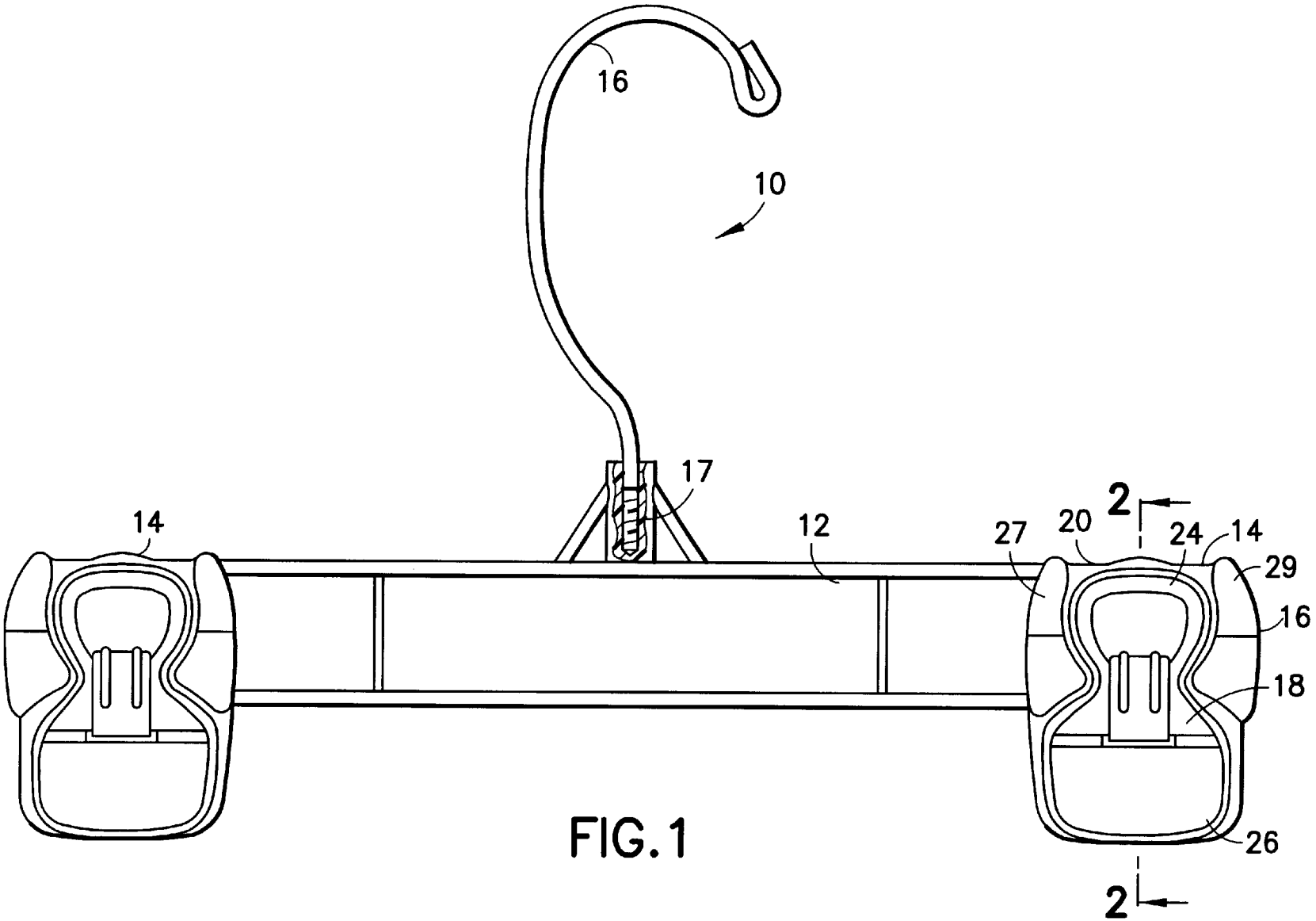
FIG. 1 is a front view of a garment hanger having a clamp according to the invention at each end of a hanger body.

Referring now to FIG. 1, a garment hanger 10 includes a hanger body 12 having at each end a pinch-type clamp 14.

Garment hanger 10 includes a partial loop or hook member 16, which may be formed from plastic or metal wire or any other appropriate material. The partial loop or hook member may be secured via threads 17 to the body 12, as shown, or may be integrally formed from the same material as body 12, or may be connected to the body in any other manner. The body 12 is preferably made from any number of well known plastic or resin materials, such as "k"-resin, polystyrene, polypropylene, polyethylene, styrene-butadiene copolymers and blends, polycarbonates, and combinations thereof.

Figure 2B:
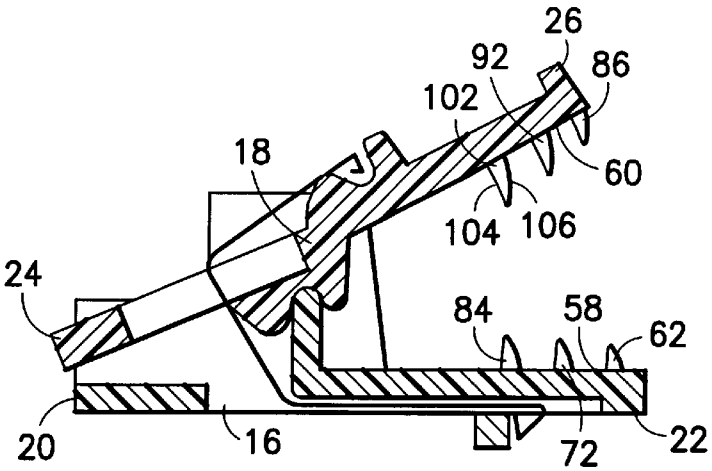
FIG. 2B is a sectional view of the garment clamp according to the invention taken along line 2—2 in FIG. 1, with the jaw members in a fully open position.
Figure 2A:
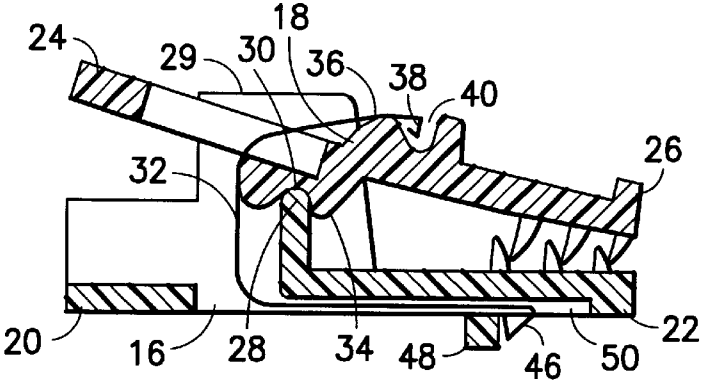
FIG. 2A is a sectional view of the garment clamp according to the invention taken along line 2—2 in FIG. 1, with the jaw members in a fully closed position.

Referring now to FIGS. 1 and 2A, the clamps 14 are preferably formed from the same material as the body 12. Each clamp 14 has a base member 16 which is preferably integrally formed with the body, and a lever member 18 movable relative thereto. The base member 16 includes a handle portion 20 and a jaw end 22, and the lever member 18 includes a handle portion 24 which is opposite handle portion 20, and a jaw end 26 which is positioned opposite jaw end 22. The lever member 18 is pivotally supported on the base member 16 along a pivot wall 28 extending between two supports 27, 29 on the base member 16. The pivot wall 28 is received in a pivot groove 30 on the back of lever member 18. A C-shaped spring clip 32, preferably made of metal, is dimensioned to receive a portion of the base member 16 and a portion of the lever member 18 and is positioned over those portions such that facing inner surfaces of the spring clip 32 bear against outwardly facing surfaces 34, 36 of the base member 16 and the lever member 18, respectively. A front end of the spring clip 32 has a flange 38 that engages within an aperture 40 in the lever member 18 to secure the spring clip 32 to the lever member. A rear end of the spring clip 32 has a tab 46 which engages a strut 48 spanning an aperture 50 in the base member 16 to secure the spring clip to the base member. The spring clip 32 urges the lever member jaw end 26 towards the base member jaw end 22.

Turning now to FIGS. 2B through 6, according to the invention, each jaw end 22, 26 is provided with a ridged gripping surface 58, 60, respectively, each including an arrangement of three substantially parallel rows of ridges (numbered below). The ridges extend substantially across the respective jaw members in a direction parallel to both the body 12 and the pivot axis of the base and lever members 14, 16. In the jaw end 22 of base member 16, a front ridge 62 is preferably comprised of four relatively smaller elongate teeth 64, 66, 68, 70, a middle ridge 72 is preferably comprised of five-relatively smaller elongate teeth 74, 76, 78, 80, 82, and a back ridge 84 preferably is one elongate tooth. In the jaw end 26 of the lever member 18, a front ridge 86 is preferably comprised of two relatively smaller elongate teeth 88, 90, a middle ridge 92 is preferably comprised of four relatively smaller elongate teeth 94, 96, 98, 100, and a back ridge 102 preferably is one elongate tooth. Each of the teeth of a particular ridge are separated from adjacent teeth by V-shaped grooves (or slots) 103 in the ridge. With respect to the middle ridges 72, 92, the grooves 103 are offset such that they do not align when the clamp 14 is in a closed or partially closed position; i.e., the grooves 103 between teeth 74 and 76, 76 and 78, 78 and 80, etc. are located adjacent teeth 94, 96, 98, and 100, and the grooves 103 between teeth 94 and 96, 96 and 98, and 98 and 100 are located adjacent teeth 76, 78, and 80. Each of the ridges, e.g., ridge 102, preferably has a rear wall 104 which extends substantially perpendicular to the surface 60 from which the ridge extends, and a front wall 106 which extends from the surface 60 and curves toward the rear wall 104 such that the ridge in cross-section (FIGS. 2 and 2B) has a cuspid-like appearance.

Each of the smaller teeth 64, 66, 68, 70, 74, 76, 78, 80, 82, 88, 90, 94, 96, 98, and 100 preferably has the same length, approximately ¼ inch. The height of front ridges 62, 86 is preferably approximately 0.06–0.07 inch, the height of the middle ridges 72, 92 is preferably approximately 0.07–0.09 inch, and the height of the back ridges 84, 102 is preferably approximately 0.13–0.014 inch.

The front and middle ridges 62, 72 on the base member 16 are separated by preferably approximately 0.12 inch, as are the front and middle ridges 86, 92 on the lever member 18. The middle and back ridges 72, 84 on the base member 16 are also separated by preferably approximately 0.12 inch, as are the middle and back ridges 92, 102 on the lever member 18.

Figure 7:
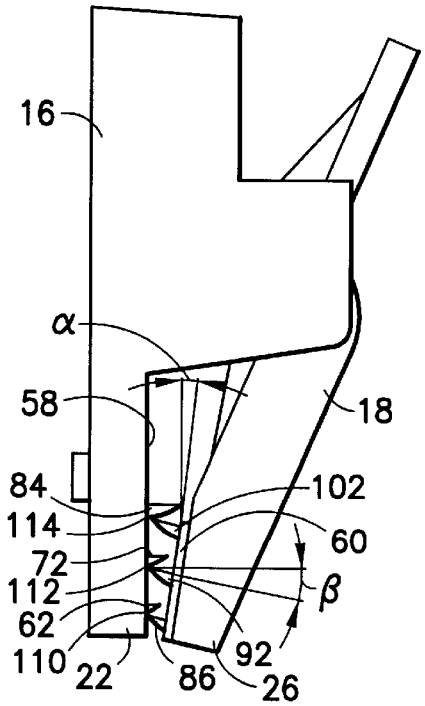
FIG. 7 is an enlarged broken side view of the left clamp in FIG. 1 in a closed position.

Referring now to FIG. 7, the surface 60 on the jaw end 26 of lever member 18 is angled at an angle $\alpha$ relative to the surface 58 on the jaw end 22 of the base member 16. When the jaw ends are in the closed position (FIG. 2A), angle $\alpha$ is preferably between 50 and 25°, and more preferably approximately 12°. In addition, while it was previously stated that the rear walls of the ridges are substantially perpendicular to the clamp surfaces, each of the ridges of lever 18 preferably angle backward relative to a normal to surface 60 by a small angle $\beta$ which is between 10 and 100, and most preferably approximately 3°. These relative angles $\alpha$ and $\beta$, as well as the ridge configuration provide that when the base and lever members 16, 18 are in the fully closed position, the front ridge 86 of the lever member 18 is directed toward a front base 110 of the front ridge 62 of the base member 16, the middle ridge 92 of the lever member 18 is directed toward a front base 112 of the middle ridge 72 of the base member, and the back ridge 102 of the lever member 18 is directed toward a front base 114 of the back ridge 84 of the base member. In each case, in the fully closed position, the ridges of lever 18 preferably contact (or nearly contact) the ridges of the base 16 at an angle of between 6° and 35° (and most preferably approximately 15°) when the clamp is fully closed.

Figure 2C:
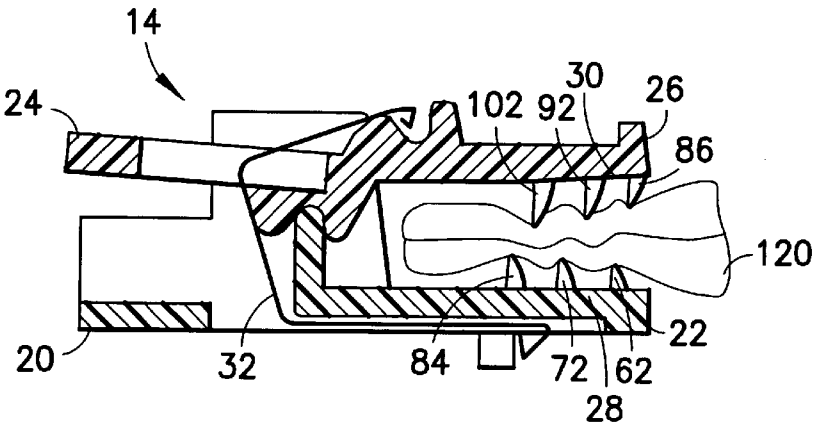
FIG. 2C is a sectional view of the garment clamp according to the invention taken along line 2—2 in FIG. 1, with the jaw members shown closed on a portion of a denim jeans garment.
Figure 3:
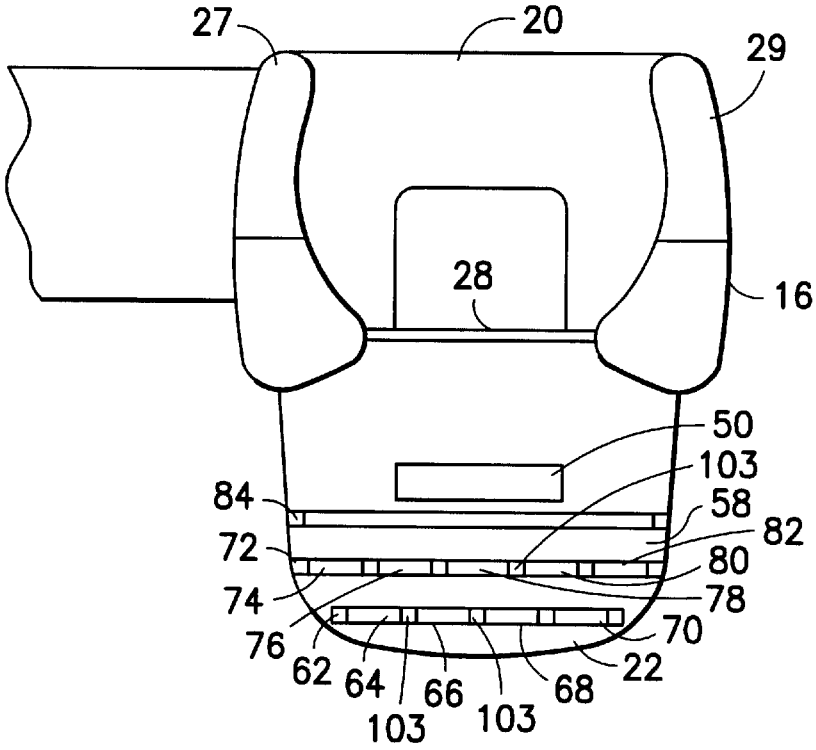
FIG. 3 is a broken front view of an inside of a first jaw member of the garment clamp according to the invention shown attached to a part of a hanger body.
Figure 4:
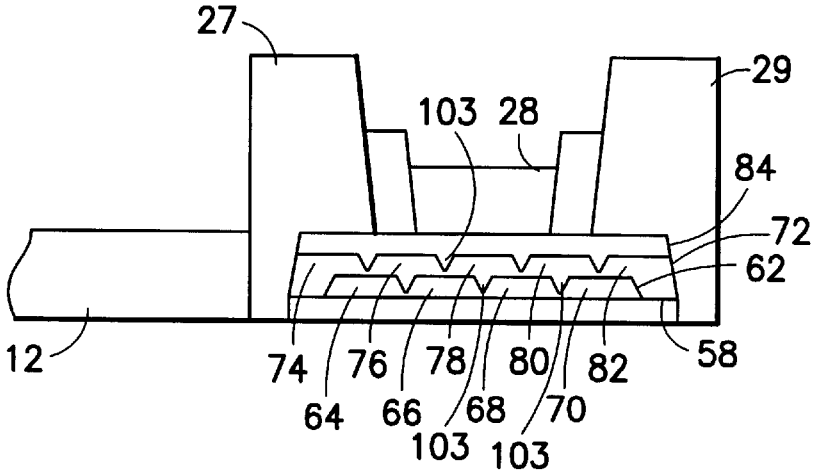
FIG. 4 is bottom view of the first jaw member shown in FIG. 3, shown attached to a part of a hanger body.
Figure 5:
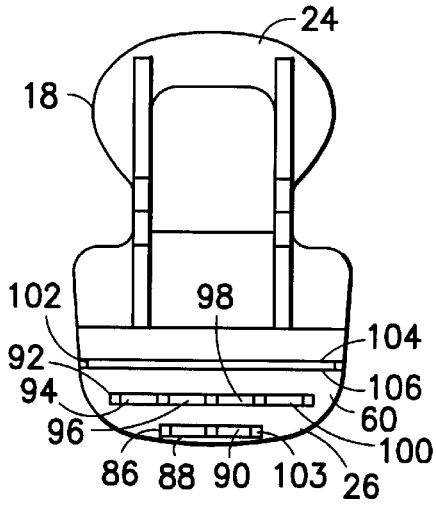
FIG. 5 is broken rear view of an inside of a second jaw member of the garment clamp according to the invention.
Figure 6:
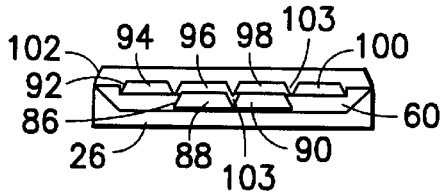
FIG. 6 is bottom view of the second jaw member shown in FIG. 5.

In use, jaw ends 22, 26 are spread apart by application of pressure to the handle portions 20, 24 sufficient to overcome the bias of the spring clip 32. With the jaw ends spread, a garment such as denim jeans can be received between the jaw ends or released from between the gripping surfaces of the jaw ends. Referring to FIG. 2C, to secure a garment 120 in the clamp 14, a part of the garment is positioned between the gripping surfaces 28, 30 of the jaw ends 22, 26, the handle portions 20, 24 are released, and the gripping surfaces are allowed to come together under the urging of the spring clip 32 and contact the garment 120. With a typical pair of denim jeans, when the clamp is closed about the jeans, ridges 62, 72 and 84 are offset from ridges 86, 92, 102. The shape and configuration of the ridges provide a superior gripping ability on denim jeans garments and prevent the premature release of a garment from the hanger, thereby eliminating the loss, damage and time required to re-hang garments when garments are prematurely released. While having excellent ability to securely hold a garment, the clamps of the hanger also permit ready release of the garment from the hanger clamp when desired, and do not damage the denim garment while holding it.

There have been described and illustrated herein several embodiments of clamp for a garment hanging device. While particular embodiments of the invention have been described, it is not intended that the invention be limited thereto, as it is intended that the invention be as broad in scope as the art will allow and that the specification be read likewise. Thus, while three ridges are preferred, it will be appreciated that two ridges or more than three ridges may be used. Also, while particular dimensions and relative angles are provided for the ridges, it will be appreciated that other dimensions and relative angles may be used. In addition, while the clamp is shown securely attached to the hanger body as an integral part of hanger body, it will be understood that this attachment method is merely illustrative of the most cost effective method of manufacturing a sturdy, attractive hanger. Furthermore, the clamp may alternatively be made separately from a material that is the same or different from the material of hanger body, and may be fixedly or movably attached to the hanger body by known means or methods. Moreover, the clamp may also be attached to hanger body by one or more intervening elements, such as, for example, a bar or rod (not shown) supported below hanger body. It will therefore be appreciated by those skilled in the art that yet other modifications could be made to the provided invention without deviating from its spirit and scope as claimed.

What is claimed is:

1. A garment hanger, comprising:

a) a body;

b) a hook member coupled to said body from which said hanger can be suspended; and c) at least one clamp coupled to said body, said clamp having a base member having a first handle portion and a first jaw end, a lever member movable relative to said base member and having a second handle portion and a second jaw end, and a clip coupling said base member and said lever member together such that said first and second jaw ends are urged toward each other into a closed position, wherein each of said first and second jaw ends includes a plurality of substantially parallel elongate ridges extending transversely across respective said jaw ends, at least one of said ridges on each of said first and second jaw ends having a cuspid cross-sectional shape.

2. A garment hanger according to claim 1, wherein:

each of said first and second jaw ends includes front, middle, and back elongate ridges.

3. A garment hanger according to claim 2, wherein:

at least one of said elongate ridges comprises distinct teeth.

4. A garment hanger according to claim 3, wherein:

said front ridge of said first jaw end comprises four teeth, and said middle ridge of said first jaw end comprises five teeth.

5. A garment hanger according to claim 3, wherein:

said front ridge of said second jaw end comprises two teeth, and said middle ridge of said first jaw end comprises four teeth.

6. A garment hanger according to claim 1, wherein:

said ridges of said first jaw end are each of a different height, and said ridges of said second jaw end are each of a different height.

7. A garment hanger according to claim 1, wherein:

said ridges on said second jaw end are angled relative to said ridges on said first jaw end when said first and second jaw ends are in said closed position.

8. A garment hanger according to claim 1, wherein:

said ridges on said second jaw end are directed at said angle toward a front base of each of said ridges on said first jaw end when said first and second jaw ends are in said closed position.

9. A garment hanger, comprising:

a) a body;

b) a hook member coupled to said body from which said hanger can be suspended; and c) at least one clamp coupled to said body, said clamp having a base member having a first handle portion and a first jaw end, a lever member movable relative to said base member and having a second handle portion and a second jaw end, and a clip coupling said base member and said lever member together such that said first and second jaw ends are urged toward each other into a closed position, wherein each of said first and second jaw ends includes exactly three substantially parallel elongate ridges extending transversely across respective said jaw ends, at least one of said elongate ridges on each of said first and second jaw ends comprising distinct teeth.

10. A garment hanger according to claim 9, wherein:

a front ridge and a middle ridge of each of said first and second jaw ends each comprises a plurality of teeth, and a back ridge of each of said first and second jaw ends each comprises a single elongate tooth.

11. A garment hanger according to claim 9, wherein:

a front ridge of said three ridges on said first jaw end comprises four teeth, and a middle ridge of said three ridges on said first jaw end comprises five teeth.

12. A garment hanger according to claim 9, wherein:

a front ridge of said three ridges on said second jaw end comprises two teeth, and a middle ridge of said three ridges of said first jaw end comprises four teeth.

13. A garment hanger according to claim 8, wherein:

said ridges of said first jaw end are each of a different height, and said ridges of said second jaw end are each of a different height.

14. A garment hanger according to claim 13, wherein:

a front ridge of said ridges on said first jaw has a first height, a middle ridge of said ridges on said first jaw has a second height, and a back ridge of said ridges on said first jaw has a third height, wherein said first height is smaller than said second height, and said second height is smaller than said third height.

15. A garment hanger according to claim 13, wherein:

a front ridge of said ridges on said second jaw has a first height, a middle ridge of said ridges on said second jaw has a second height, and a back ridge of said ridges on said second jaw has a third height, wherein said first height is smaller than said second height, and said second height is smaller than said third height.

16. A garment hanger according to claim 15, wherein:

said first height is 0.06–0.07 inch, said second height is approximately 0.07–0.09 inch, and said third height is approximately 0.13–0.014 inch.

17. A garment hanger according to claim 9, wherein:

said ridges on said second jaw end are angled relative to said ridges on said first jaw end when said first and second jaw ends are in said closed position.

18. A garment hanger according to claim 9, wherein:

said ridges on said second jaw end are directed toward a front base of each of said ridges on said first jaw end when said first and second jaw ends are in said closed position.

19. A garment hanger according to claim 9, wherein:

each of said ridges has a cuspid cross-sectional shape.

20. A garment hanger, comprising:

a) a body;

b) a hook member coupled to said body from which said hanger can be suspended; and c) at least one clamp coupled to said body, said clamp having a base member having a first handle portion and a first jaw end, a lever member movable relative to said base member and having a second handle portion and a second jaw end, and a clip coupling said base member and said lever member together such that said first and second jaw ends are urged toward each other into a closed position, wherein each of said first and second jaw ends includes a plurality of substantially parallel elongate ridges extending transversely across respective said jaw ends, said ridges on said second jaw end being angled at an angle toward said second handle portion relative to a normal to a surface from which said ridges on said second jaw end extend.

21. A garment hanger according to claim 20, wherein:

said angle is between 1° and 10°.

22. A garment hanger according to claim 20, wherein:

said ridges on said second jaw end are angled between 5° and 25° relative to said ridges on said first jaw end when said first and second jaw ends are in said closed position.

23. A garment hanger according to claim 20, wherein:

said ridges on said second jaw end are directed toward a front base of each of said ridges on said first jaw end when said first and second jaw ends are in said closed position.

24. A garment hanger according to claim 20, wherein:

each of said teeth has a length of approximately ¼ inch.

25. A garment hanger, comprising:

a) a body;

b) a hook member coupled to said body from which said hanger can be suspended; and c) at least one clamp coupled said body, said clamp having a base member having a first handle portion and a first jaw end, a lever member movable relative to said base member and having a second handle portion and a second jaw end, and a clip coupling said base member and said lever member together such that said first and second jaw ends are urged toward each other into a closed position, wherein said first and second jaw ends each includes a plurality of substantially parallel elongate ridges extending transversely across said respective first and second jaw ends, said ridges on said second jaw end being angled at an angle relative to said ridges on said first jaw end when said first and second jaw ends are in said closed position.

26. A garment hanger according to claim 25, wherein:

said ridges on said second jaw end are directed toward a front base of each of said ridges on said first jaw end when said first and second jaw ends are in said closed position.

27. A garment hanger according to claim 25, wherein:

said angle is 5° to 25°.

28. A garment hanger according to claim 25, wherein:

said angle is approximately 12°.

29. A denim jeans garment and garment hanger assembly, comprising:

a) a denim jeans garment; and b) a garment hanger, including, i) a body;

ii) a hook member coupled to said body from which said hanger can be suspended, and iii) at least one clamp coupled to said body, said clamp having a base member having a first handle portion and a first jaw end, a lever member movable relative to said base member and having a second handle portion and a second jaw end, and a clip coupling said base member and said lever member together such that said first and second jaw ends are urged toward each other, wherein each of said first and second jaw ends includes a plurality of substantially parallel elongate ridges molded integrally with said respective jaw ends and extending transversely across respective said jaw ends, at least one of said ridges on each of said first and second jaw ends having a pointed cross-sectional shape, and each of said ridges on each of said respective jaw ends having a different height from the others, wherein said ridges on said first jaw end are offset relative to said ridges on said second jaw end when said garment is provided in said clamp and said jaw ends are in a closed position, about said garment.

* * * * *